US006745502B1

(12) United States Patent
Desmarais et al.

(10) Patent No.: US 6,745,502 B1
(45) Date of Patent: Jun. 8, 2004

(54) RAIL MOUNTED EXCAVATING UNIT AND BALLAST STORAGE VEHICLE

(75) Inventors: Lionel Charles Desmarais, Bolton (CA); Andrew Smith Jackson, Cambridge (CA); Bernie A. Stene, Landsdowne (CA); Mark E. Nye, Mississauga (CA)

(73) Assignee: Ledcor IP Holdings Ltd., Vancouver (CA)

( * ) Notice: Subject to any disclaimer, the term of this patent is extended or adjusted under 35 U.S.C. 154(b) by 0 days.

(21) Appl. No.: 09/565,174

(22) Filed: May 3, 2000

Related U.S. Application Data

(62) Division of application No. 09/054,364, filed on Apr. 2, 1998, now Pat. No. 6,076,288.

(51) Int. Cl.[7] ..... E02F 5/22
(52) U.S. Cl. ..... 37/104
(58) Field of Search ..... 37/104, 105, 107, 37/40, 26, 832; 171/16; 405/124, 175, 176

(56) References Cited

U.S. PATENT DOCUMENTS

| | | | | |
|---|---|---|---|---|
| RE13,194 | E | * | 1/1911 | Cafferty |
| 1,555,793 | A | | 9/1925 | Stage |
| 3,019,536 | A | * | 2/1962 | Kershaw |
| 3,232,358 | A | | 2/1966 | Heiberg |
| 3,571,956 | A | | 3/1971 | Heiberg |
| 4,036,379 | A | | 7/1977 | Godfrey et al. |
| 4,096,954 | A | | 6/1978 | Buckner |
| 4,101,180 | A | | 7/1978 | Anderson et al. |
| 4,102,066 | A | | 7/1978 | Christoff |
| 4,113,031 | A | | 9/1978 | Venable |
| 4,152,991 | A | * | 5/1979 | Stedman et al. |
| 4,162,087 | A | | 7/1979 | Avrillon |
| 4,190,394 | A | | 2/1980 | Herzog et al. |
| 4,274,212 | A | * | 6/1981 | Kurkela et al. |
| 4,379,371 | A | * | 4/1983 | Jenkins et al. |
| 4,384,619 | A | | 5/1983 | Schuck |
| 4,705,288 | A | | 11/1987 | Schmidt |
| 4,736,534 | A | | 4/1988 | Daniels et al. |
| 4,854,751 | A | | 8/1989 | Grassmuck et al. |
| 4,890,958 | A | | 1/1990 | Dancer |
| 5,052,133 | A | * | 10/1991 | Mohr |
| 5,066,188 | A | | 11/1991 | Bush |
| 5,084,989 | A | * | 2/1992 | Theurer et al. |
| 5,094,018 | A | * | 3/1992 | Theurer et al. |
| 5,192,137 | A | | 3/1993 | Renard |

(List continued on next page.)

FOREIGN PATENT DOCUMENTS

| | | |
|---|---|---|
| DE | 363460 | 11/1922 |
| DE | 1455203 | 7/1964 |
| DE | 1222443 | 8/1966 |
| EP | 522765 A2 | 1/1993 |
| FR | 1.055.194 | 10/1953 |
| FR | 71.00940 | 10/1980 |
| FR | 80.21071 | 10/1980 |
| GB | 727788 | 4/1955 |
| GB | 747143 | 3/1956 |
| GB | 1029341 | 5/1966 |

OTHER PUBLICATIONS

Trade brochure entitled "KRAC", date unknown but at least as early as 1993.

Trade brochure entitled "RWF Bron Offset Pipe/Cable Plow", date unknown but at least as early as 1993.

*Primary Examiner*—Victor Batson
(74) *Attorney, Agent, or Firm*—Thomas E. Malyszko

(57) ABSTRACT

A rubber tired railway plow (100) has a plow unit (102) mounted to a plate (111) which extends across the forward end of the rubber tired vehicle (100). The plow unit (102) is attached so as to be movable on the plate (111). Wedges (122, 123) are used to maintain the plow unit (102) in position on the plate (111). When the wedges (122, 123) are removed, the plow unit (102) is movable on the plate (111) from one side of the vehicle (100) to the opposite side thereby to be able to plow on either side of the rails (141).

2 Claims, 11 Drawing Sheets

U.S. PATENT DOCUMENTS 5,365,854 A * 11/1994 Theurer
5,459,951 A * 10/1995 McCray et al.
5,511,485 A * 4/1996 Romani et al.
5,553,674 A * 9/1996 Theurer et al.
5,596,822 A 1/1997 Desmarais et al.
5,611,403 A * 3/1997 Theurer et al.
5,657,700 A * 8/1997 Bounds
5,732,441 A 3/1998 Janian
6,021,717 A * 2/2000 Theurer
6,076,288 A * 6/2000 Desmarais et al.

* cited by examiner

RAIL MOUNTED EXCAVATING UNIT AND BALLAST STORAGE VEHICLE

CROSS-REFERENCE TO RELATED APPLICATION

This application is a division of application Ser. No. 09/054,364 filed Apr. 2, 1998, now issued as U.S. Pat. No. 6,076,288.

INTRODUCTION

This invention relates to a railway plow and, more particularly, to a railway plow and associated apparatus which is useful in burying cable in the bed of a railway.

BACKGROUND OF THE INVENTION

Fiber optic cable is increasingly being used for telecommunications and other data forwarding purposes. Such cable allows a large capacity increase relative to the use of copper or aluminum wire and is particularly valuable for increasing capacity for digital and analog communications. The location of such cable, however, is of considerable importance because if the fiber optic cable is damaged or severed, extensive telecommunication failure can occur.

In order to prevent damage to the telecommunications cable, the cable is preferably buried. Right of way is difficult to obtain and is expensive in any event. To avoid the problems with right of way and in order to better protect the cable, the cable has been laid in railroad beds. This is advantageous in that the right of way has already been obtained and that railroads have their own benefits in allowing the burial of fiber optic cable so that the cable might also be used for their own communications purposes. Likewise, the network of rail lines is extensive so that cable can be laid to virtually any location where there is a significant population base.

The cable is typically laid using a rubber tired railway plow such as that plough disclosed in our U.S. Pat. No. 5,596,822 dated Jan. 28, 1997. The plow there disclosed, however, suffered from various disadvantages.

First, the plow was mounted on the front end of the rubber tired vehicle and was designed to plow on only one side of the track on which the vehicle is mounted. In order to plow on the opposite side of the track on which the plow moved, the plow was required to be manually removed from the mounting bracket on the forward end of the vehicle by physical detachment of the plow. The plow was then manipulated usually with a front end loader so that it could be positioned on a second mounting bracket on the opposite side of the vehicle. Then, the plow was remounted on the second mounting plate. Such a method was time consuming, required a plurality of operators and was quite inefficient.

Second, the railway plow according to the '822 patent had a single set of railwheels mounted on the forward end of the plow. In the event the plow hit something hard in the ballast or in the overburden during the plowing process, the impact force would be conveyed back to the plow itself and could result in the single pair of railwheels leaving the track. This necessitated the remounting of the vehicle on the track as well as repositioning the plow during such remounting. This process was time consuming and inefficient.

Third, since a circuit is needed between the rails to provide a signal to the roadcrossing signals at a crossing location and since it is not desirable to close the gates or maintain the bells or other noises at such crossing locations during cable burying or excavation operations in the vicinity of such crossing, insulation within the railwheels was needed to prevent the road crossing signals from being initiated by the operation of the nearby railplow, excavator or other equipment. Prior insulation used in the railwheels had a very short lifespan because the impact forces, particularly during the plowing operations, are significant. The premature replacement of the insulation within the railwheels was expensive because downtime of equipment was necessary.

Fourth, the railway plow according to the '822 patent was maintained in its vertical position on the track by the use of a rear high rail. This high rail, however, provided no input to the profile of the railway being worked on. For example, as the machine approached a crossing, the rubber tires would tend to raise the plow with the railwheels leaving the rails. This is disadvantageous since it is time consuming to reconfigure the vehicle on the rails.

Fifth, there is some difficulty in positioning the rubber tired vehicle according to the '822 patent on the rails of the railway. This is so because the vehicle is of the articulated type and movements of the vehicle under certain conditions is difficult to carry out with the result that positioning the vehicle on track, particularly where the track is located in an elevated location, is a more tedious proposition that otherwise would be the case.

Sixth, it may be the case that the overburden is not easily penetrated by the plow if the overburden is rock or rocky material as in mountainous or shield operating conditions. In this event, excavation of the overburden together with the ballast of the railway will be necessary prior to passage by the plow. In excavating the railway, the overburden and ballast is normally placed beside the track is a convenient location and is replaced after the excavating operation whereupon when the plow reaches the excavated location, it will easily pass through the overburden and properly bury the cable. However, the overburden may be located in an area where it is not easily deposited beside the track such as in tunnels or mountainous passes where there is no room available to place the overburden being removed. In this event, the excavated overburden needs to be removed and deposited at a location far removed from the area being excavated. This is time consuming and inefficient, particularly so where the overburden is to be replaced immediately following its excavation.

Seventh, in the event that an excavating vehicle is used to remove the overburden and ballast, the excavating vehicle must be moved to the next location where excavation is to occur. Moving the excavating vehicle under its own power is slow and requires manpower. This is inefficient and expensive.

SUMMARY OF THE INVENTION

According to one aspect of the invention, there is provided a rubber tired railway plow having a mounting plate extending across the forward end of the vehicle so as to extend generally across the track of a railway, and a plow member mounted on said mounting plate, said plow being removably attached to said mounting plate and being movable on said mounting plate from one side of said mounting plate on one side of said vehicle to the opposite side of said mounting plate on the opposite side of said vehicle.

According to a further aspect of the invention, there is provided a method of moving a plow unit from one side of said mounting plate to the opposite side of said mounting plate comprising loosening said plow on said one side of said mounting plate, sliding said plow to the opposite side of said mounting plate by moving said plow along and in contact with said mounting plate and tightening said plow on said opposite side of said mounting plate.

According to yet a further aspect of the invention, there is provided a railway plow having a forward set of two pairs of railwheels, each of said railwheels being rotatable about a railwheel axis, said two pairs of railwheels further being rotatable around a bogey axis located substantially symmetrically relative to said railwheel axes.

According to a further aspect of the invention, there is provided a method of mounting two pairs of railwheels to a railway plough comprising providing a bogey axis of rotation on said vehicle generally symmetrical to said railwheels and allowing rotation of said railwheels about said bogey axis of rotation.

According to yet a further aspect of the invention, there is provided a railwheel operably positioned on track, said railwheel having an axis and an insulated liner operably positioned between said axis of said railwheel and said track, said insulated liner being press fitted into said railwheel and being made of nylon molybdenum disulfide material.

According to still yet a further aspect of the invention, there is provided a high rail positioned on a railway plough, said high rail comprising a pair of railwheels being hydraulically rotatable about a bogey axis, and an accumulator maintained at a predetermined pressure, said accumulator substantially maintaining a predetermined contact force between said railwheels and said track during operation of said railway plow on said track.

According to still yet a further aspect of the invention, there is provided a rail mounted excavating unit for removing ballast and overburden from said railway and a rail mounted storage vehicle for holding said ballast and overburden, said rail mounted storage vehicle being connected to and movable with said rail mounted excavating unit.

According to still yet a further aspect of the invention, there is provided a rail wheel mounted rail mover for supporting and moving an excavating unit, said rail mover including rail wheels for transport on said rails and a support for supporting said excavating unit.

According to still yet a further aspect of the invention, there is provided a method of supporting and transporting an excavating unit comprising the steps of excavating an area of ballast and overburden with said excavating unit, positioning said excavating unit on a rail mounted rail mover, transporting said excavating unit to a further excavating area and excavating at said further excavating area.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1A:
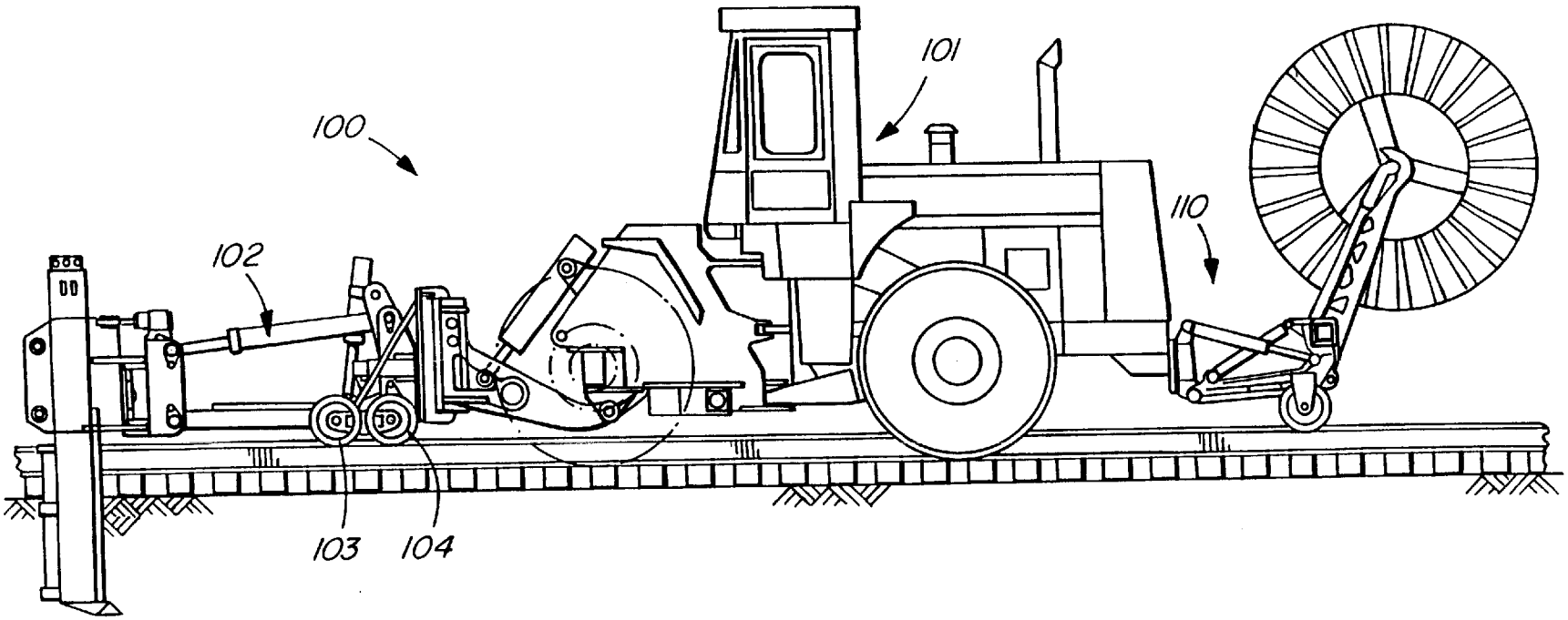
FIG. 1A is a diagrammatic side view of the railway plow according to the present invention.
Figure 1B:
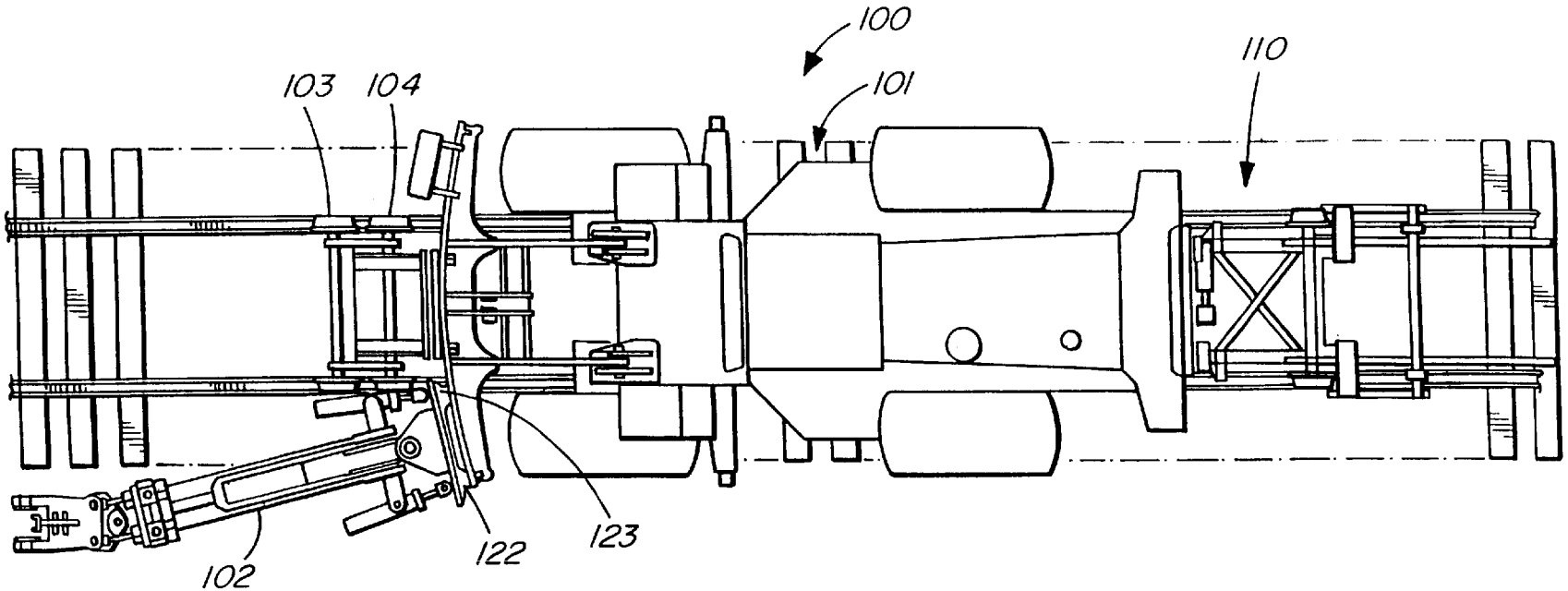
FIG. 1B is a diagrammatic plan view of the railway plow of FIG. 1A.

Referring now to the drawings, a rubber tired railway plow according to the present invention is generally illustrated at 100 in FIGS. 1A and 1B. It comprises a vehicle generally illustrated at 101, a plow unit generally illustrated at 102 which is mounted on the forward end of the vehicle 101, railwheels 103, 104 mounted on the vehicle 101 and a high rail unit generally illustrated at 110 which is positioned on the rear end of the vehicle 101.

Figure 2A:
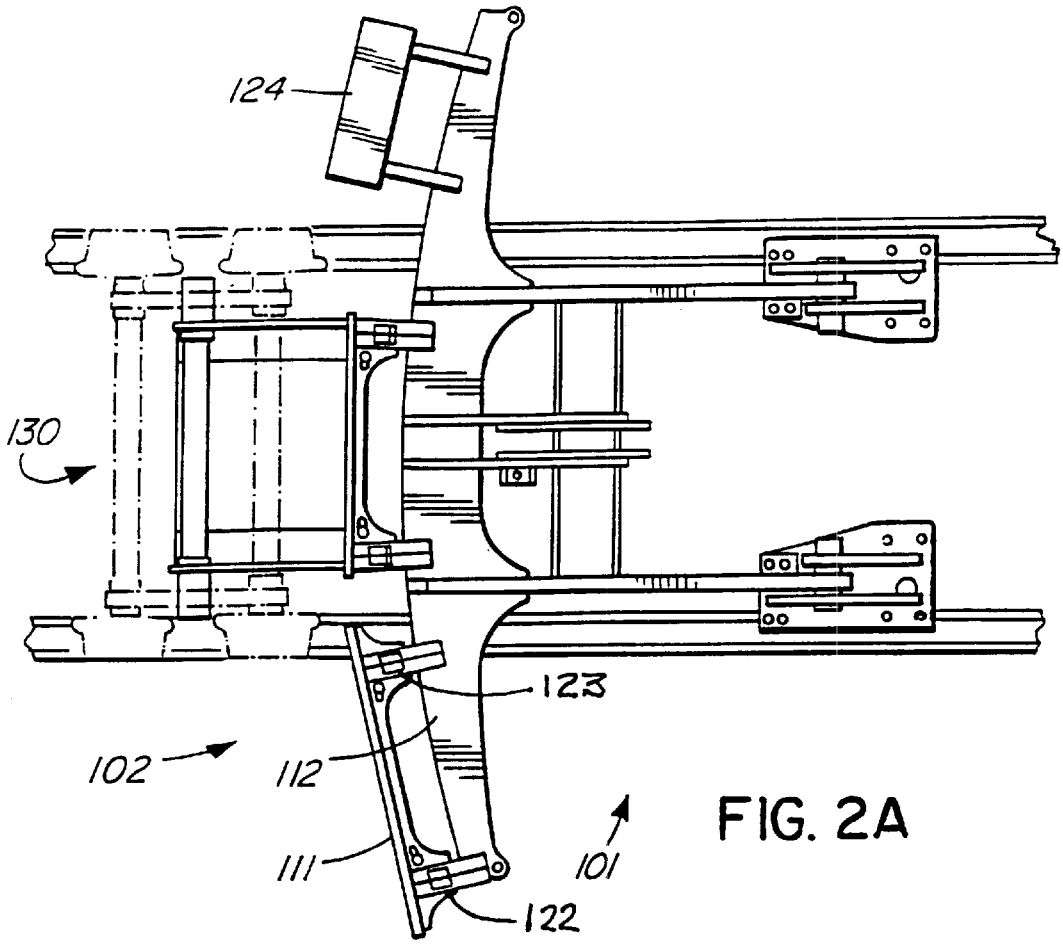
FIG. 2A is a plan view of the plow mounting system according to the present invention.

With reference to FIG. 2A, the plow 102 is shown in a mounted configuration on one side of the mounting plate 111. Mounting plate 111 is, in turn, mounted to the forward end of the vehicle 101 on an arc shaped steel bracket 112. The mounting plate 111 comprises a pair of hook shaped members 113, 114 which are fitted over the edges of the bracket 112. A pair of hydraulic pistons 120, 121 are mounted between the bracket 112 and the mounting plate 111. The pistons 120, 121 are operated by a pneumatic over hydraulic pump (not illustrated). A pair of wedges 122, 123 are mounted on each side of the mounting plate 111. The wedges 122, 123 are removable so as to loosen the connection between the mounting plate 111 and the steel bracket 112. A counterweight 124 is also mounted on arc shaped bracket 112 and a high rail unit generally illustrated at 130 is mounted to the center of the arch shaped bracket 112.

Figure 2B:
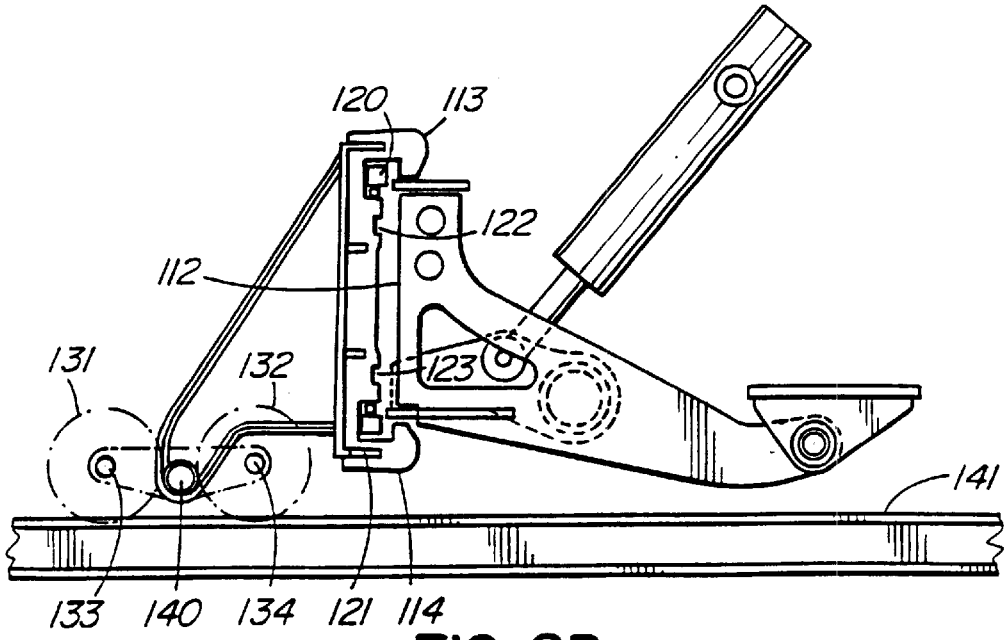
FIG. 2B is a side view of the plow mounting system of FIG. 2A.

The high rail unit 130 includes a pair of railwheels 131, 132. Each pair of railwheels 131, 132 has a respective axis 133, 134 about which they rotate. The railwheels 131, 132 are bogey mounted so that the railwheels 131, 132 rotate about bogey axis 140. Thus, if an impact received at the railwheels 131, 132, it tends to raise one of the railwheels 131, 132 off the track 141 (FIG. 2B), the other of the pair of railwheels 131, 132 will tend to be lowered and maintain the position of the railwheels 131, 132 on the track 141, thereby to keep the plow 100 on the track 141.

Figure 3A:
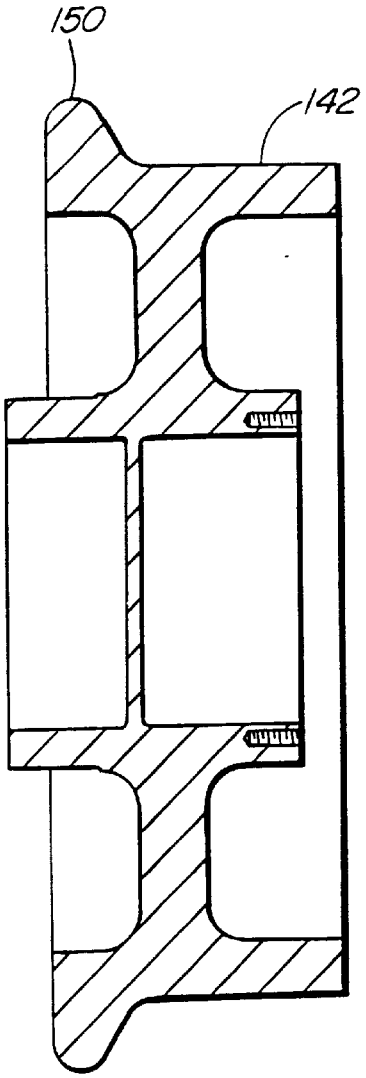
FIG. 3A is a cross-sectional view of a railwheel used with the plow according to the present invention.
Figure 3B:
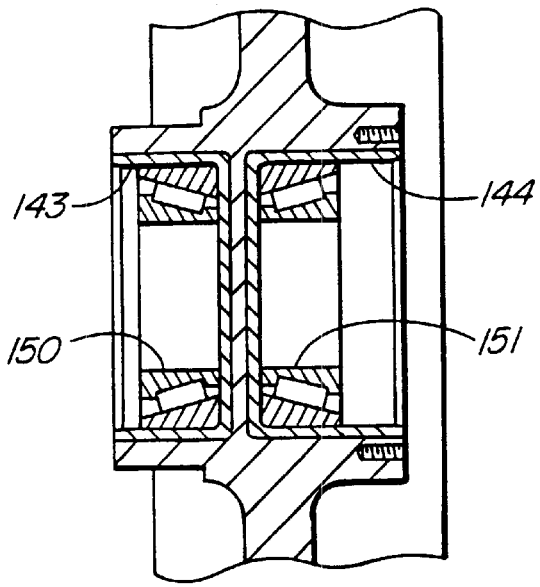
FIG. 3B is a view of the railwheel of FIG. 3A with insulating bushings added according to a further aspect of the invention.

The railwheels 131, 132 will create a circuit between the rails 141 on which the move if they are not insulated from the rails 141. The circuit will commence the operation of crossing warning devices and the like. In the event the railbed equipment is working in the vicinity of the crossing, such devices are not needed and their use causes traffic problems. Reference is made to FIGS. 3A and 3B which illustrate a railwheel 142 with two insulators 143, 144 added. Insulators 143, 144 are press fitted into the railwheel 142 and bearings 150, 151 are subsequently press fitted into the insulators 143, 144. The insulators 143, 144 are made of nylon MDS (molybdenum-disulfide) material commonly known as GSM (Trademark) material. The GSM material has been found to have significantly longer life than other insulating materials particularly considering the great loading and impact forces to which the railwheels 142 are subjected. Nevertheless, it has been found that the operational life of the GSM insulating materials 143, 144 are further extended if the railwheels 142 in which the insulating material is mounted are used on the plow 100 on the side of the plow 100 opposed to the side on which the plow member 102 is mounted. This is so because the flange 150 of the railwheel 142 is subject to repeated impacts with the rail 141 as the plow 102 moves through the ground in which it is operating.

Figure 4:
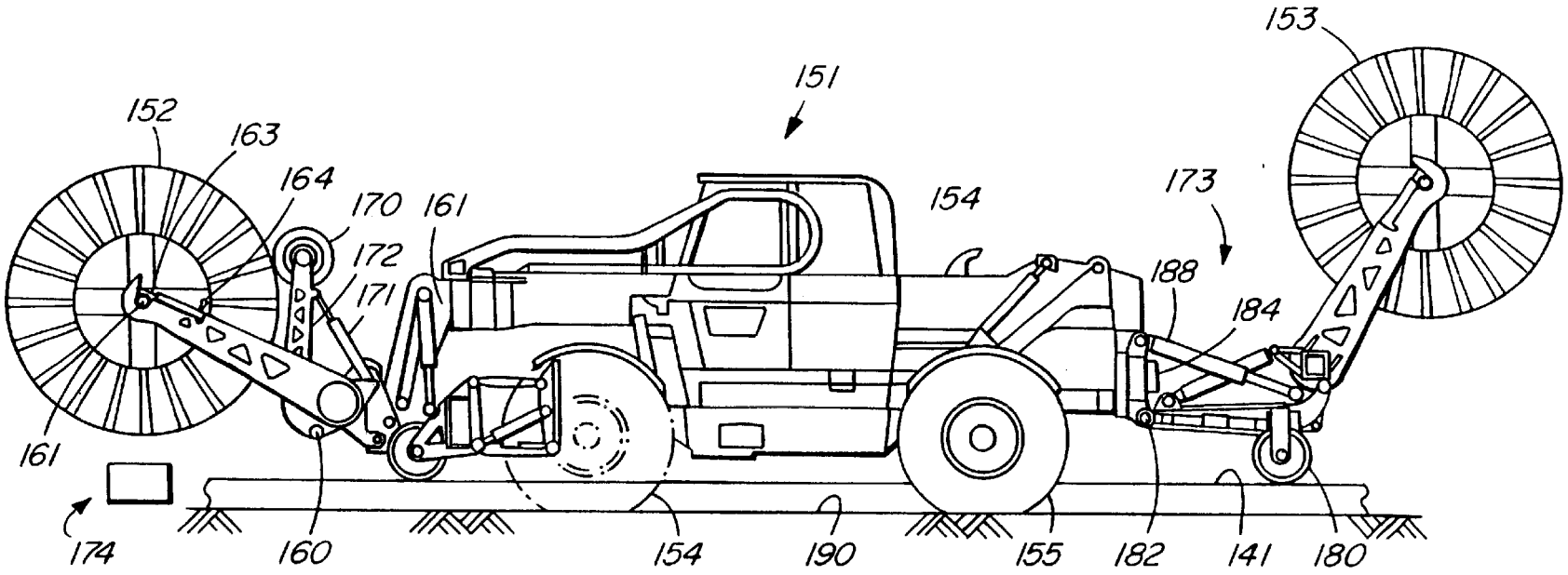
FIG. 4 is a diagrammatic side view of a cable winder according to a further aspect of the invention, the winder being mounted on a vehicle of the non-articulated nature which uses steerable forward and rearward wheels.

The cable winder apparatus is illustrated generally at 151 in FIG. 4. The cable winder apparatus 151 includes a forwardly mounted reel 152 and a rearwardly mounted reel 153. The vehicle 154 on which the cable winder apparatus 151 is mounted is a vehicle of the non-articulated variety with steerable forward and rearward tires 154, 155. The use of such a vehicle 154 with the steerable wheels has been found to be advantageous in cable laying operations. This is so because the vehicle 154 can be more easily manipulated in achieving an operating position on the railway tracks 141, particularly when the tracks 141 are located in an elevated position and the vehicle 154 is required to be moved onto the elevated tracks 141. It is contemplated that such a vehicle 154 could also conveniently be used for the purpose of actually operating the plow unit 102 similarly to the use of the articulated vehicle 100 illustrated in FIG. 1.

The cable winder apparatus 151 comprises a pair of reel holding arms 154 movable through an operating arc about axis 160. Reel 152 is positioned on an axial shaft 161 which extends between the reel holding arms 154. Shaft 161 has ends which are carried by the open ends 162 of reel holding arms 154. A retainer 163 in each arm 154 holds shaft 161 in position in arms 154. Each retainer 163 is manually movable by handle 164 so that the u-shaped open ends 162 can receive a shaft 161 on which the reel 152 is mounted and, after the shaft 161 is held in the open ends 162, the handle 164 is moved so as to retain the reel 152 in each of the open ends 162 to prevent it leaving the open ends 162 under operating conditions. The retainer 163 may also be operated remotely by the use of air, for example, where retrieval and disposition of a reel from the cab of the vehicle is desired.

Cable winder 151 further includes a pair of drive wheels 170. Drive wheels 170 are driven by a hydraulic motor (not illustrated) which is used to increase or decrease the speed of the drive wheels 170 which are in contact with reel 152 and thereby increase or decrease the speed with which the cable is laid on the ground preceding the plow unit vehicle 100. Contact between the drive wheels 170 and the fiber optic cable on reel 152 is achieved by hydraulic cylinder 171 which rotates the drive wheel arms 172 about axis 160 and maintains contact between the drive wheels 170 and the fiber optic cable on the reel 152. The drive wheels 170 are adjustable as to the width between the drive wheels 170 and the position of each drive wheel 170 on the mounting shaft for the drive wheels 170.

A remote operating control system 174 is used to allow the movement of reel 152 outside the cab of vehicle 151. The remote operating control system 174 is useful when the vehicle 151 has reached a road or tunnel beneath which the cable is to be laid. In this instance, the cable must be entirely removed from reel 152 so that the end of the cable remote from the end previously buried by the plow vehicle 100 may be obtained and then passed under the roadway or other obstacle. Thereafter, the cable is rewound on reel 152 by an operator. Thus, the use of a remote control system 174 allows the operator to wind and rewind the cable from outside the vehicle 151.

A high rail unit generally illustrated at 173 is mounted on the rear of vehicle 151. The high rail unit 173 comprises a pair of railwheels 180 extending between arms 181 which are rotatable about axis 182 by hydraulic cylinders 183. An accumulator 184 is used in the hydraulic circuit so that when the railwheels 180 are lowered to the rails 141, pressure of a predetermined value is maintained in the hydraulic circuit. This will maintain a desired force between the railwheels 180 and the track. This is advantageous for when the elevation of the surface 190 on which the tires 154, 155 are operating is changed, the railwheels 180 will be maintained in contact with rail 141 whereas without such predetermined force, the railwheels 180 would tend to depart from the surface of rail 141 thereby requiring the vehicle 151 to be remounted on the rails 141. The high rail unit 173 is similarly and conveniently used on other vehicles including the plow 100 (FIGS. 1A and 1B).

Figure 5B:
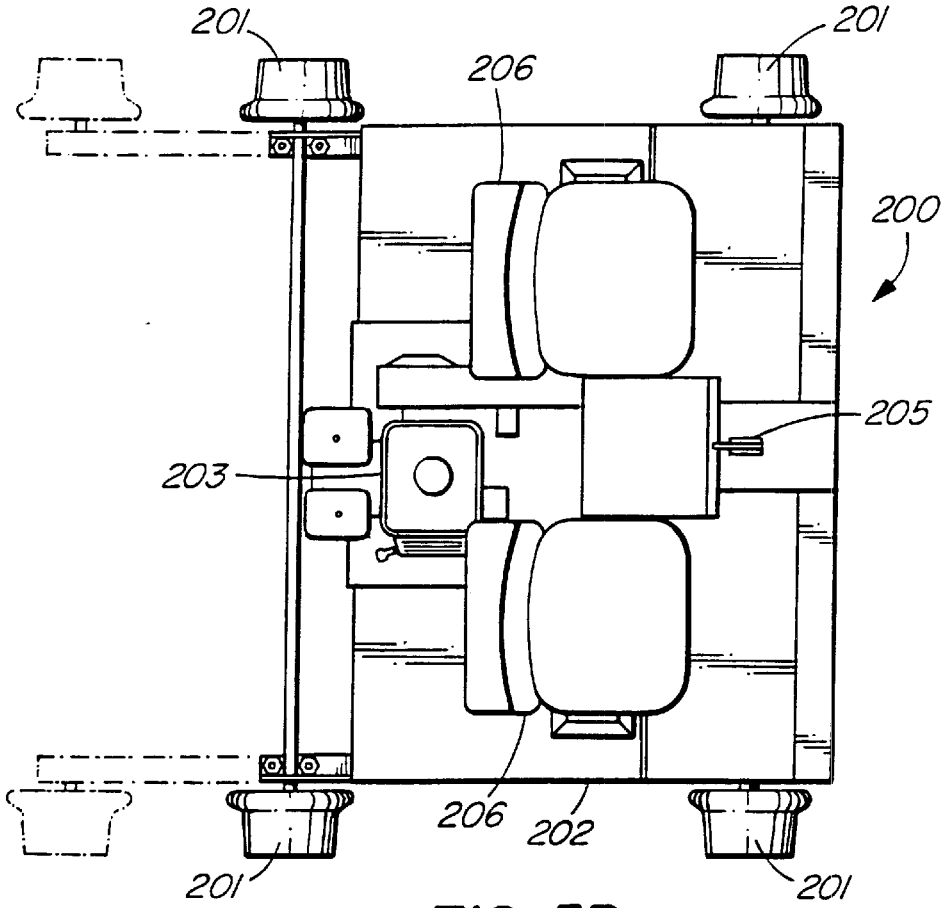
FIGS. 5A and 5B are side and plan views, respectively, of a railcart according to a further aspect of the invention.
Figure 5A:
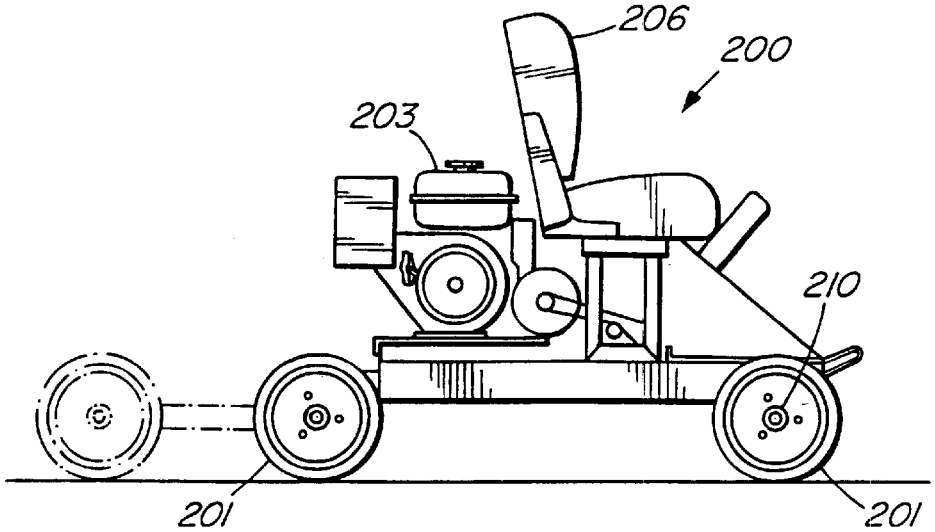

Reference is now made to FIG. 5 which illustrates a light railcart generally illustrated at 200. Railcart 200 is intended to be manually movable by two persons into and off the track of a railway and, likewise, to fit within the bed of a pickup truck. To that end, the structure of the railcart 200 to utilises railwheels 201 made entirely of the aforementioned GSM material and the frame 202 is made from aluminum. A small gasoline engine 203 is mounted on the railcart 200 and is connected with a drive sprocket 204 on the front axle 210 which rotates with railwheels 201 and thereby drives the railcart 200 along the rails on which it operates. An operators control 205 allows the operator in the seats 206 to connect the motor 203 with the drive sprocket 204 thereby to move the railcart 200 on the tracks. The maximum weight of the railcart 200 is not intended to exceed 300 pounds although a lighter weight is desirable. Likewise, the dimensions of the railcart 200 should be such that it may conveniently be loaded into the bed of a pickup truck and, accordingly, the width of the railcart 200 is approximately sixty-eight (68) inches with the length being approximately forty (40) inches in its retracted position and sixty five (65) inches in its extended position as viewed in the figures.

Figure 6A:
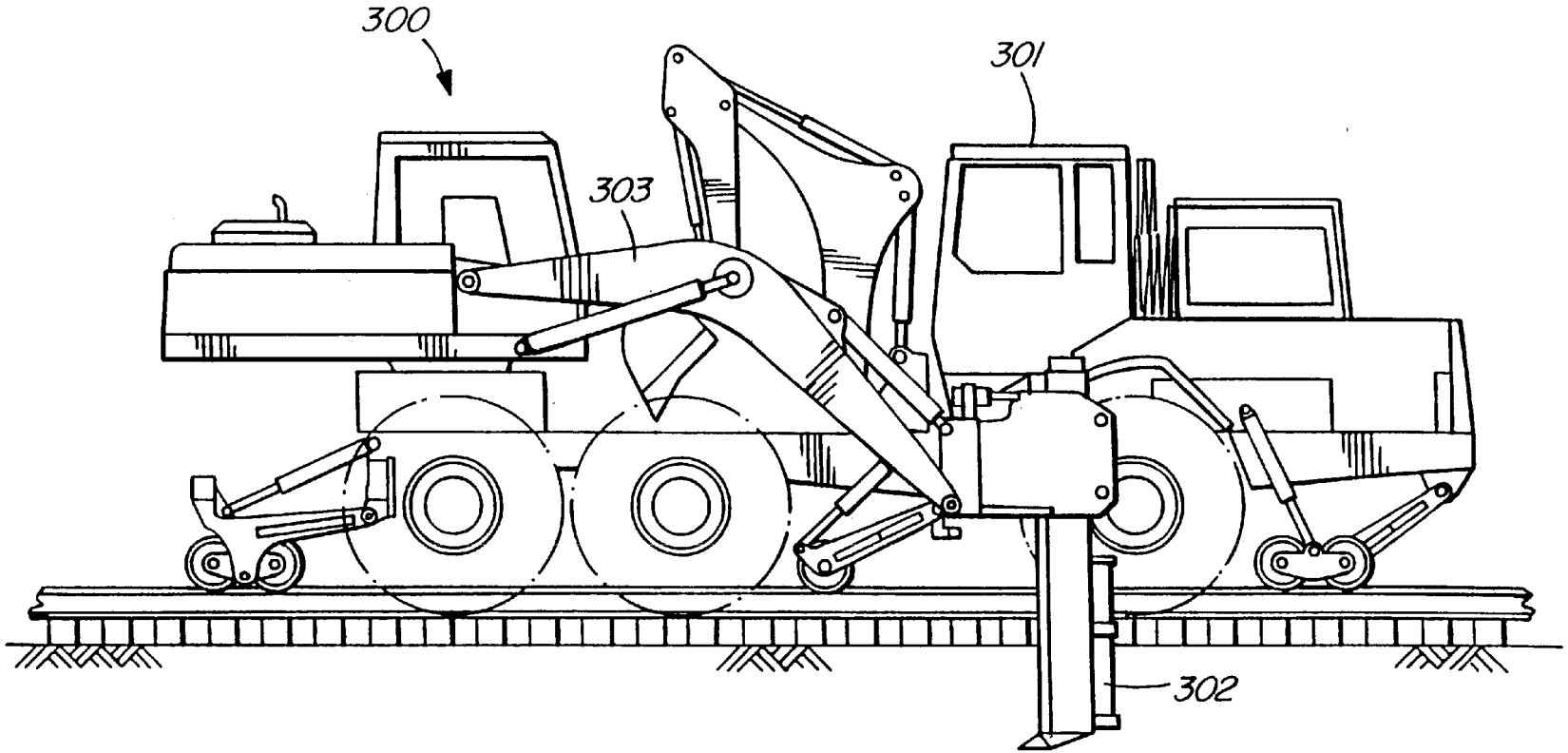
FIGS. 6A, 6B and 6C are views of a cable plow being mounted on an excavator according to yet a further embodiment of the invention.
Figure 6B:
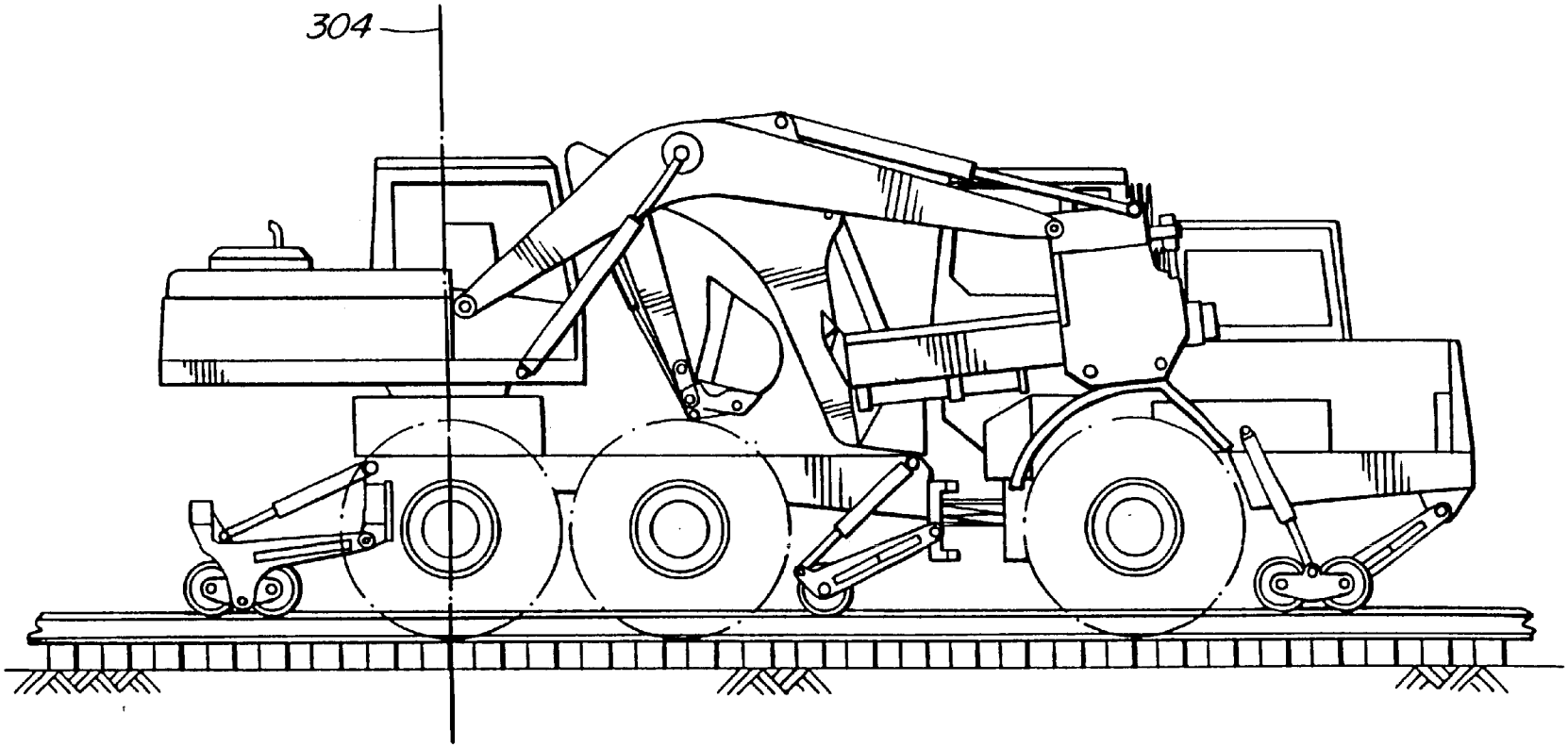
Figure 6C:
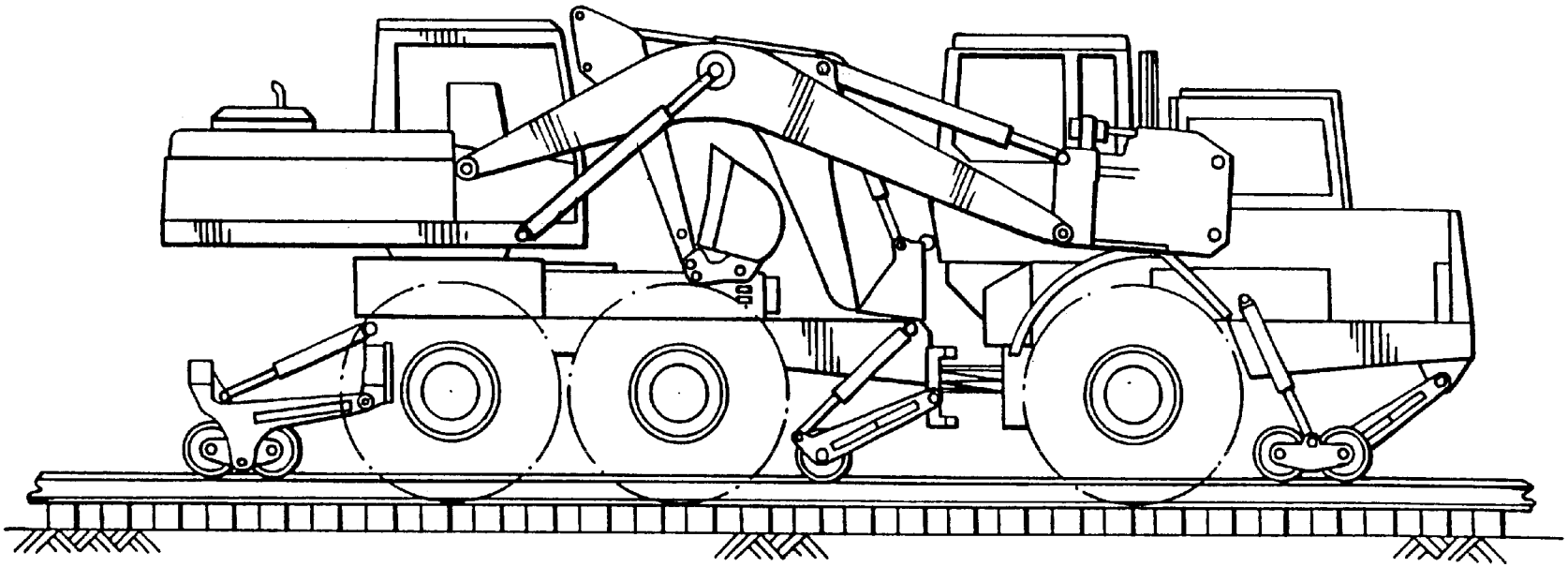

Yet a further embodiment of the invention is illustrated in FIGS. 6A, 6B and 6C. In this embodiment, an excavator unit generally illustrated at 300 is mounted on a vehicle 301 so as to rotate about an axis 304 as is known and the cable plow 302 is mounted on the end of the excavator boom 303. This embodiment of the invention is useful due to the flexibility of the boom 303. The boom 303 may be extended to both sides of the vehicle 301 and thereby plow on either side of the track 310 with minimal changes to the configuration of the vehicle 301 and excavator 300.

Figure 7:
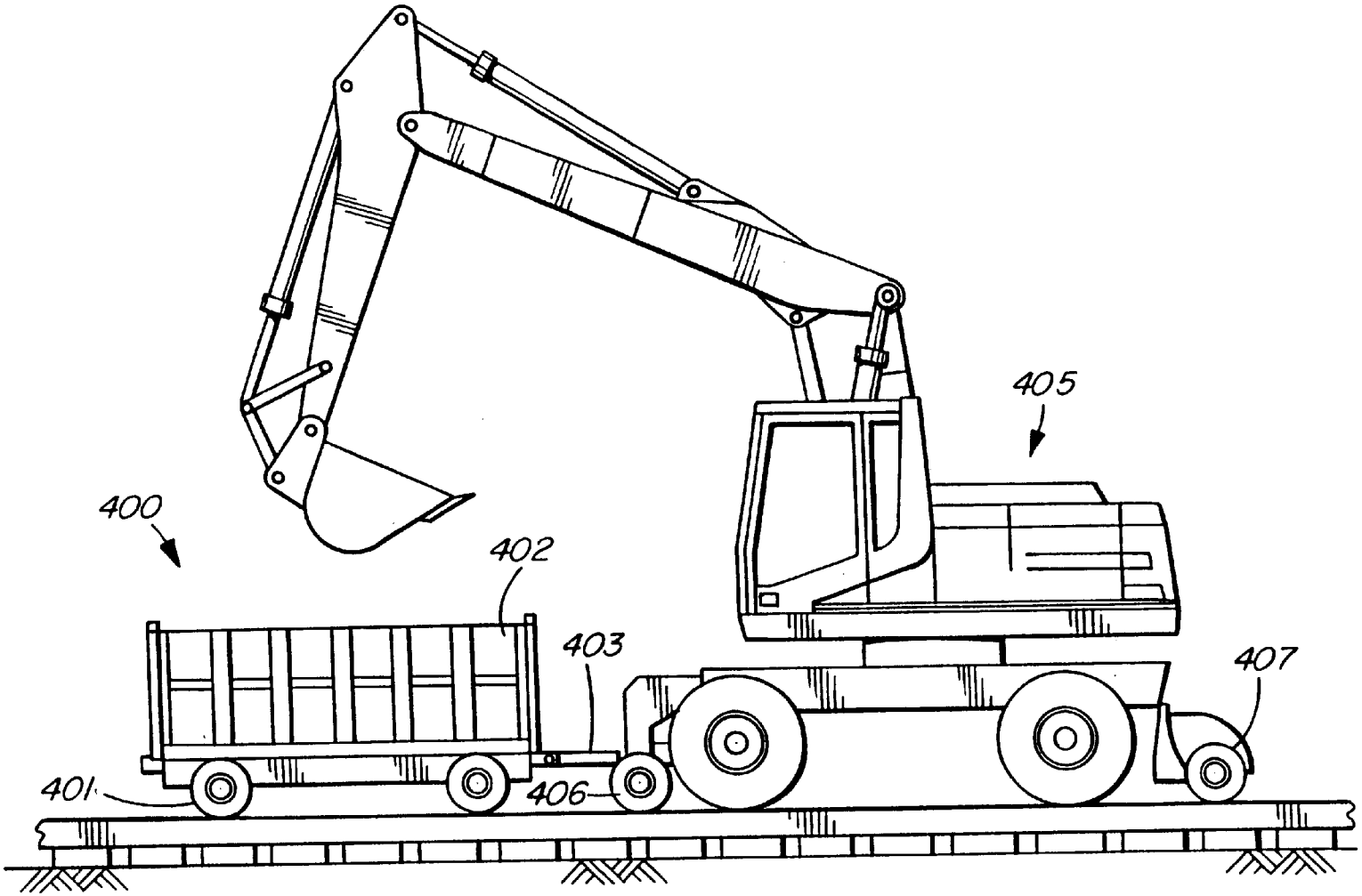
FIG. 7 is a side view of an excavator used with a gravel box according to a further aspect of the invention.

Reference is now made to FIG. 7 which illustrates an excavator unit generally illustrated at 405 and which is operable on railwheels 406, 407 and which is conveniently rubber tired. the excavator 405 is connected to a gravel box generally shown at 400 which is mounted on rail wheels 401, 402 and which includes a hitch assembly 403 which is connected to the excavator unit 405.

Normally, the excavator unit 405 proceeds far in advance of the actual plow used to bury the cable. The excavator 405 excavates the ballast and the overburden. Frequently, they may be no area to store the excavated material in which event the excavated material is placed in the gravel box 400 until the excavation is complete. At that time, the excavated material is then replaced by the excavator 405 and the excavation unit 405 proceeds to the next location to be excavated. The gravel box 400 is simply connected to the excavator unit 405 by hitch 403 and accompanies it from location to location where excavation is to occur.

Figure 8A:
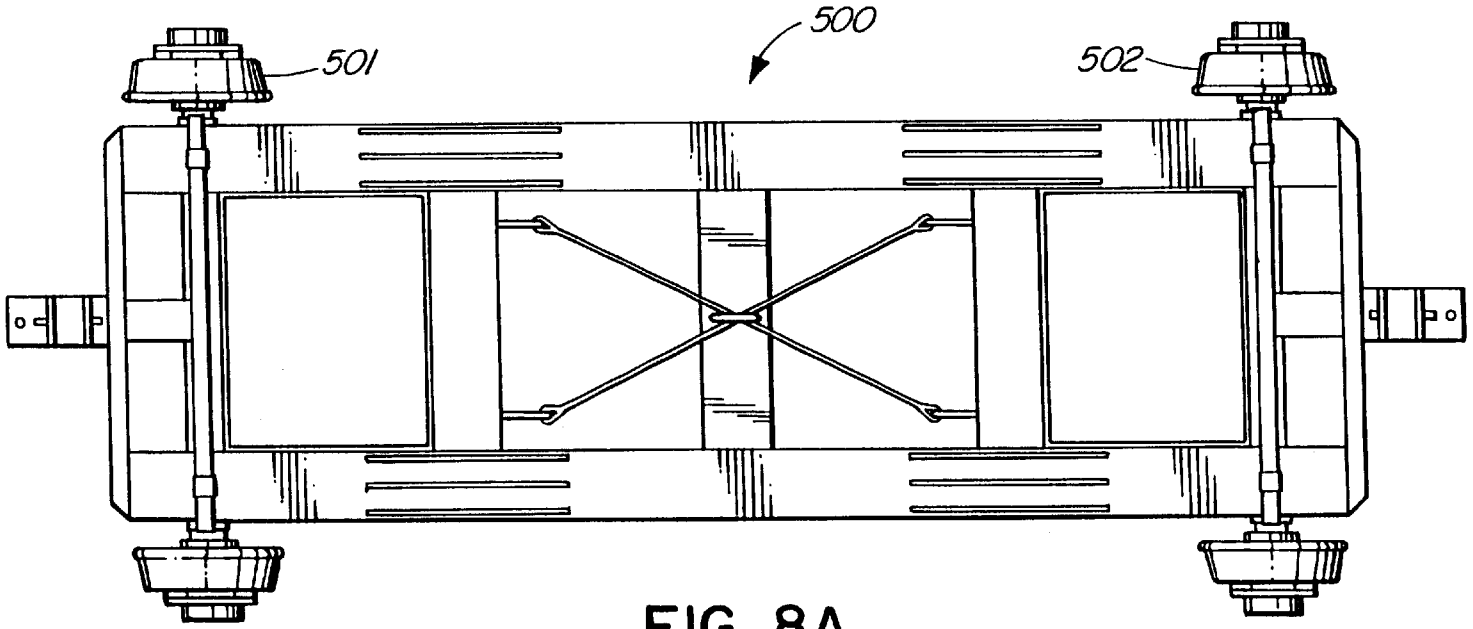
FIGS. 8A and 8B are plan and side views, respectively, of a rail mover used for transporting an excavating unit.
Figure 8B:
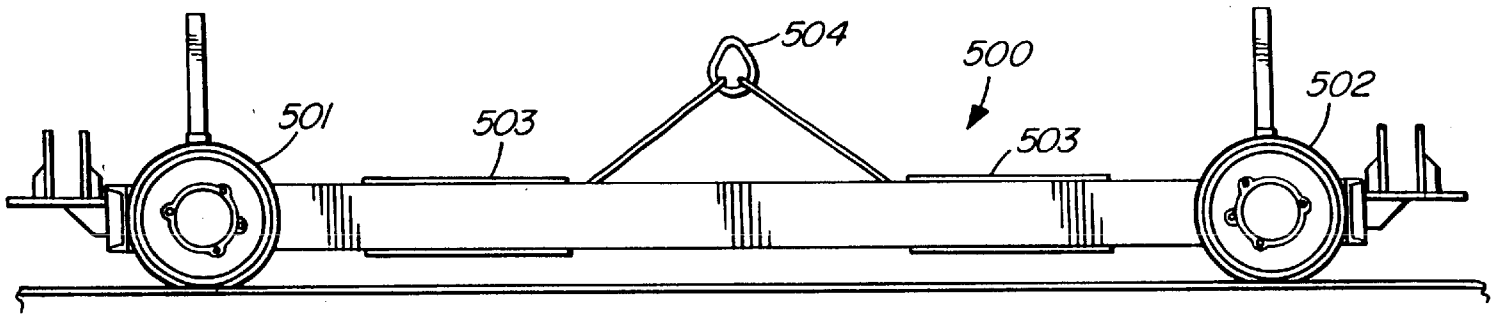

Reference is now made to FIGS. 8A and 8B. A rail mover is generally illustrated at 500. Rail mover 500 has rail wheels 501, 502 and a support platform 503 for supporting an excavating unit such as unit 405 in FIG. 7 to be transported by the rail mover 500. A vehicle tie down 504 is provided to allow the attachment of chains, straps and the like which will encircle the excavating unit during transport and securely maintain it during transportation on the rail mover 500.

In operation, the excavating unit 405 will proceed with the excavation of the desired area. Following the excavation, the excavator 405 is simply driven onto the rail mover 500 and appropriately secured using the tie down 504. Thereafter, the excavator unit 405 will be moved more speedily to its new operating position by the rail mover 500.

The specific embodiments described should be taken as illustrative of the invention only and not as limiting its scope. Many further modifications and changes will readily occur to those skilled in the art to which the invention relates and the inventions should be construed in accordance with the accompanying claims.

We claim:

1. A rail mounted excavating unit on a first railcar for removing ballast and overburden from a railbed and a rail mounted storage vehicle for storing ballast and overburden, said rail mounted storage vehicle being on a second railcar for holding said ballast and overburden removed by said excavating unit, said rail mounted storage vehicle on said second railcar being connected to and moveable with said rail mounted excavating unit on said first railcar, said first and second railcars being connected through a hitch assembly, said rail mounted storage vehicle holding said removed ballast and overburden and allowing said removed ballast and overburden to be returned to said railbed, and further comprising a railway plow having a forward set of two pairs of rail wheels, each of said railwheels being rotatable about a railwheel axis, said two pairs of railwheels further being rotatable about a bogey axis located substantially symmetrically relative to said railwheel axes.

2. A rail mounted excavating unit on a first railcar for removing ballast and overburden from a railbed and a rail mounted storage vehicle for storing ballast and overburden, said rail mounted storage vehicle being on a second railcar for holding said ballast and overburden removed by said excavating unit, said rail mounted storage vehicle on said second railcar being connected to and moveable with said rail mounted excavating unit on said first railcar, said first and second railcars being connected through a hitch assembly, said rail mounted storage vehicle holding said removed ballast and overburden and allowing said removed ballast and overburden to be returned to said railbed, and further comprising a high rail positioned on a railway plow, said high rail comprising a pair of railwheels begin hydraulically rotatable about a bogy axis, and an accumulator maintained at a predetermined pressure, the accumulator substantially maintaining a predetermined contact force between said railwheels and track during operation of said railway plow on said track.

* * * * *